3/11/80 XR 4,192,552

United States Patent [19]

Cha

[11] 4,192,552

[45] Mar. 11, 1980

[54] METHOD FOR ESTABLISHING A COMBUSTION ZONE IN AN IN SITU OIL SHALE RETORT HAVING A POCKET AT THE TOP

[76] Inventor: Chang Y. Cha, 1904 Glenmont Dr., Bakersfield, Calif. 93309

[21] Appl. No.: 892,451

[22] Filed: Apr. 3, 1978

[51] Int. Cl.[2] ..... E21C 41/10; E21B 43/24

[52] U.S. Cl. ..... 299/2; 166/261; 166/302; 299/11; 299/13

[58] Field of Search ..... 299/4, 5, 11, 2, 13; 166/302, 261, 259, 272, 274

[56] References Cited

U.S. PATENT DOCUMENTS

| | | | |
|---|---|---|---|
| 3,382,922 | 5/1968 | Needham | 166/272 |
| 3,460,620 | 8/1969 | Parker | 166/247 UX |
| 3,533,469 | 10/1970 | Parker | 166/247 |
| 3,550,685 | 12/1970 | Parker | 166/259 |
| 3,741,306 | 6/1973 | Papadopoulos | 166/252 |

*Primary Examiner*—William Pate, III
*Attorney, Agent, or Firm*—Arnold Grant

[57] ABSTRACT

An in situ oil shale retort having a top boundary of unfragmented formation and containing a fragmented permeable mass has a pocket at the top, that is, an open space between a portion of the top of the fragmented mass and the top boundary of unfragmented formation. To establish a combustion zone across the fragmented mass, a combustion zone is established in a portion of the fragmented mass which is proximate to the top boundary. A retort inlet mixture comprising oxygen is introduced to the fragmented mass to propagate the combustion zone across an upper portion of the fragmented mass. Simultaneously, cool fluid is introduced to the pocket to prevent overheating and thermal sloughing of formation from the top boundary into the pocket.

58 Claims, 2 Drawing Figures

Figure 1:
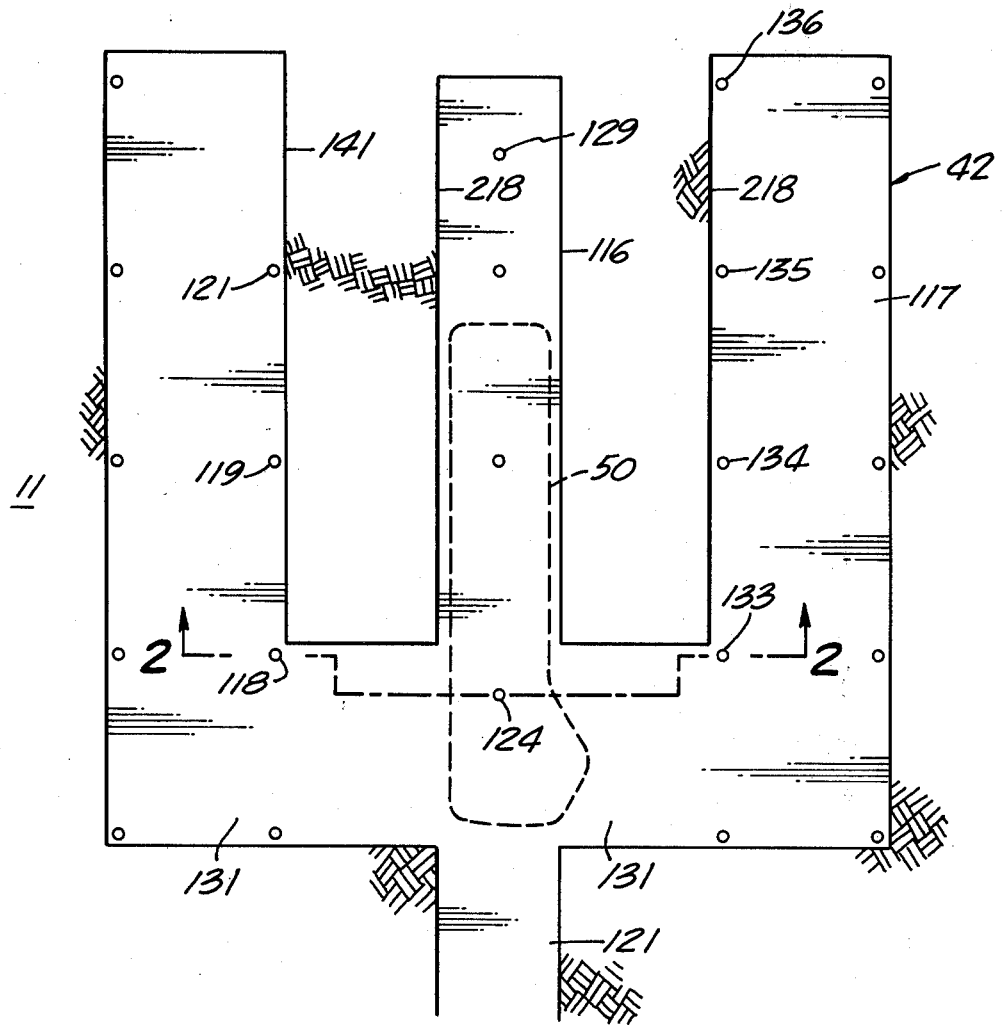

METHOD FOR ESTABLISHING A COMBUSTION ZONE IN AN IN SITU OIL SHALE RETORT HAVING A POCKET AT THE TOP

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon produce is called "shale oil".

A number of methods have been proposed for processing the oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herin by this reference. This patent describes in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passes through the in situ oil shale retort to convert kerogen contained in the oil shale to liquid and gaseous products, thereby producing retorted oil shale.

One method of supplying hot retorting gases used for converting kerogen contained in the oil shale, as described in U.S. Pat. No. 3,661,423, includes establishment of a combustion zone in the retort and introduction of an oxygen containing retort inlet mixture downwardly into the retort as an oxygen supplying gaseous combustion zone feed to advance the combustion zone downwardly through the retort. In the combustion zone oxygen in the combustion zone feed is depleted by reaction with hot carbonaceous materials to produce heat and combustion gas. By the continued introduction of the retort inlet mixture downwardly into the retort, the combustion zone is advanced downwardly through the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products including gaseous and liquid hydrocarbon products and to a residual solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas containing combustion gas generated in the combustion zone, gaseous products produced in the retorting zone, gas from carbonated decomposition, and any gaseous retort inlet mixture that does not take part in the combustion process is also withdrawn from the bottom of the retort. The products of retorting are referred to herein as liquid and gaseous products.

The residual carbonaceous material in the retorted oil shale can be used as fuel for advancing the combustion zone through the retorted oil shale. When the residual carbonaceous material is heated to its spontaneous ignition temperature it reacts with oxygen. As the residual carbonaceous material becomes depleted in the combustion process, the oxygen penetrates further into the oil shale retort where it combines with remaining unoxidized residual carbonaceous material, thereby causing the combustion zone to advace through the fragmented oil shale.

The rate of retorting of the oil shale to liquid and gaseous products is temperature dependent, with relatively slow retorting occurring at 600° F., and relatively rapid retorting of the kerogen in oil shale occurring at 950° F. and higher temperatures. As the retorting of a segment of the fragmented oil shale in the retorting zone progresses and less heat is extracted from the gases passing through the segment, the combustion gas heats the oil shale farther on the advancing side of the combustion zone to retorting temperatures, thus advancing the retorting zone on the advancing side of the combustion zone.

U.S. patent application Ser. No. 790,350 filed on Apr. 25, 1977, by Ned M. Hutchins, assigned to the assignee of this application, and incorporated herein by this reference, describes a method of forming an in situ oil shale retort in a subterranean formation containing oil shale. According to the '350 patent application, a first portion of the subterranean formation is excavated at a working level to form an open base of operation at an elevation in the formation above the top boundary of the fragmented mass being formed. A second portion of the formation is excavated for forming at least one void within the boundaries of the fragmented mass being formed. A third portion of the formation is expanded toward such a void to form a fragmented permeable mass of particles containing oil shale and to leave a horizontal sill pillar of unfragmented formation between the top of the fragmented mass and the bottom of the base of operation. As used herein, the term "horizontal sill pillar" refers to unfragmented formation between a working level and the top boundary of a fragmented mass. The term "working level" refers to the general elevation in a subterranean formation at which underground workings or galleries are excavated and utilized in the formation of a fragmented mass below a horizontal sill pillar in a retort being formed. Underground workings include excavations of any desired configuration, such as drifts, adits, tunnels, cross-cuts, rooms or the like.

In preparation of a retort by a method such as described in the '350 application, a portion of the top of the fragmented permeable mass can be separated from the top boundary of unfragmented formation by a substantially empty pocket or void. The presence of such a pocket can be a very serious problem during retorting of oil shale in the fragmented mass, because if unfragmented formation above the pocket is heated to a temperature of about 400° to 500° F. or higher, such unfragmented formation can slough into the pocket.

Sloughing of formation into such a pocket is very undesirable. Such sloughing can jeopardize the stability of the overlying formation. If the top boundary of the fragmented mass is the bottom of a sill pillar, and if excessive thermal sloughing occurs, the horizontal sill pilar could be weakened, therby damaging the base of operation.

Another very undesirable effect of thermal sloughing is that unfragmented formation sloughing into a pocket can cause difficulty in start-up due to cold raw oil shale being added to the rubble pile. Moreover, if a large quantity of overlying formation sloughs into a pocket, the amount of fuel required for start-up may be greatly increased.

There is a need for a method for retorting oil shale below a pocket in a fragmented permeable mass, and for establishing a combustion zone in the fragmented mass below such a pocket.

SUMMARY OF THE INVENTION

An in situ oil shale retort in a subterranean formation containing oil shale has a top boundary of unfragmented formation and contains a fragmented permeable mass of formation particles. A portion of the top of the fragmented permeable mass is separated from the top boundary by a pocket and another portion of the top of the fragmented permeable mass is proximate to the top boundary.

A combustion zone is established in the fragmented mass below the pocket and oil shale below the pocket is retorted. This is effected by establishing a combustion zone in a portion of the fragmented permeable mass that is proximate to the top boundary. A retort inlet mixture comprising sufficient oxygen for propagating the combustion zone across an upper portion of the fragmented mass is introduced to the combustion zone in the fragmented mass. There is introduced to the pocket a fluid having a temperature less than the temperature at which unfragmented formation of the top boundary would thermally slough into the pocket. The fluid is introduced to the pocket at a sufficient rate of flow to prevent thermal sloughing of formation from the top boundary into the pocket.

Preferably the pressure of gas in the pocket is maintained at least equal to the pressure of gas in the fragmented mass adjacent the pocket so flow of hot gases into the pocket and propagation of the combustion zone to the pocket are prevented.

Propagation of the combustion zone across an upper portion of the fragmented mass can be assisted by including fuel in the retort inlet mixture.

DRAWINGS

Figure 2:
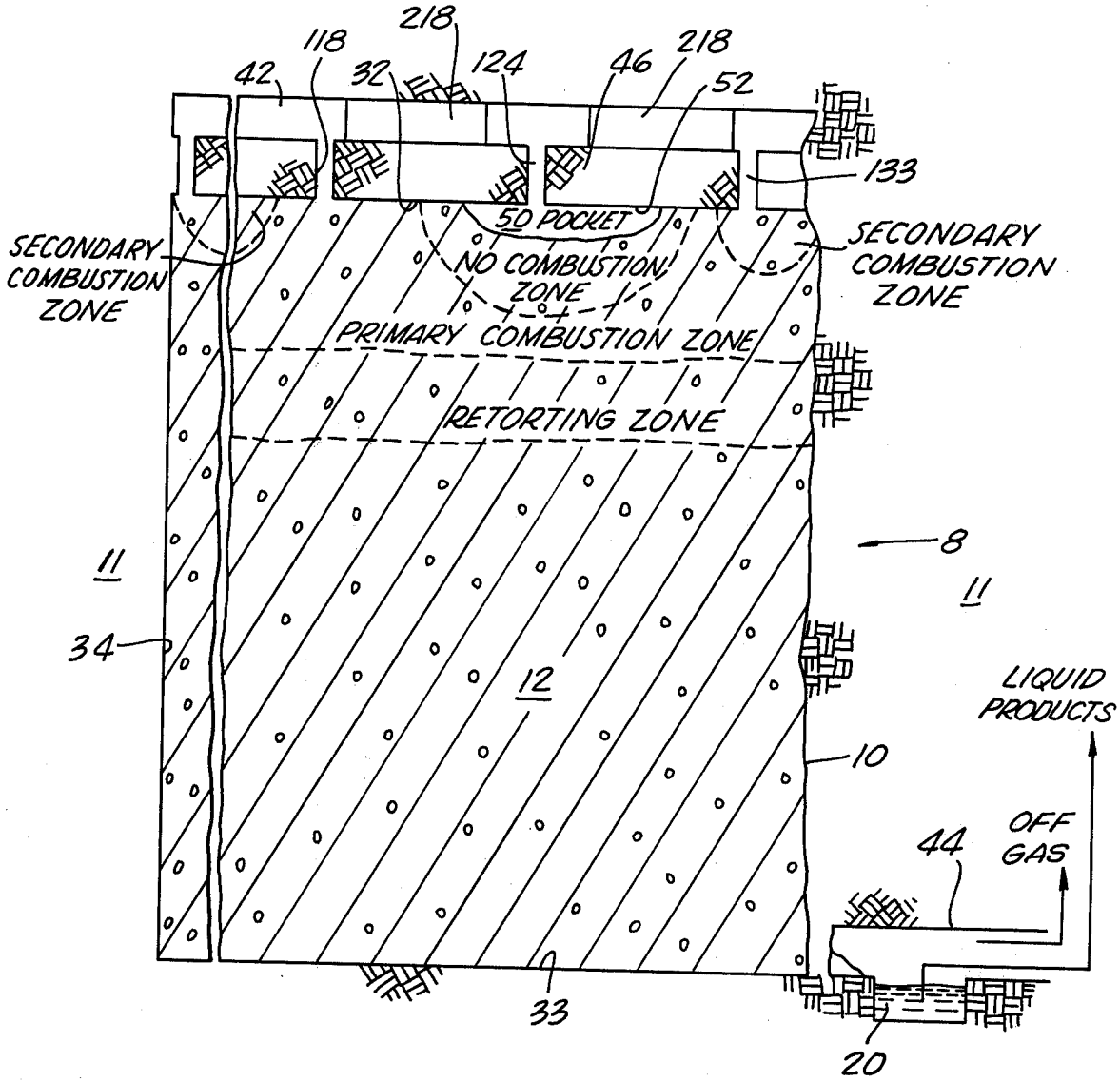

These and other features, aspects, and advantages of the present invention will become more apparent when considered with respect to the following description, appended claims, and accompanying drawings wherein:

FIG. 1 is a plan view of a base of operation of an in situ oil shale retort useful in practice of this invention; and FIG. 2 is a semi-schematic view of the retort of FIG. 1 taken on line 2—2 in FIG. 1.

DESCRIPTION

Referring to FIG. 2, an in situ oil shale retort 8 is in the form of a cavity 10 in a subterranean formation 11 containing oil shale. The in situ retort contains a fragmented permeable mass 12 of formation particles containing oil shale. The cavity has top 32, bottom 33, and side 34 boundaries of unfragmented formation serving as gas barriers. The cavity and fragmented mass of oil shale particles can be created simultaneously by blasting by any of a variety of techniques. Methods for forming an in situ oil shale retort are described in the aforementioned U.S. Pat. Nos. 3,661,423; 4,043,595; 4,043,596; 4,043,597; and 4,043,598.

A method for forming an in situ oil shale retort as described in the aforementioned patent application Ser. No. 790,350 is useful for explanation. With reference to FIG. 2, a portion of the formation is excavated to form a base of operation 42 on an upper working level. A drift 44 or similar means of access is excavated through formation at a lower level to a location underlying the base of operation. Such lower level is identified herein as a "production level" which designates underground workings at an elevation in the formation at or below the bottom of such an in situ retort.

In preparing such a retort, at least one void is excavated from within the boundaries of the fragmented mass being formed, such a void being connected to the access drift on the production level underlying the base of operation. This leaves another portion of the formation within the boundaries of the retort being formed which is to be fragmented by explosive expansion toward such void. The void is excavated only to an elevation above the access drift that leaves a horizontal sill pillar 46 of unfragmented formation between the top of the void and the bottom of the base of operation. The surface of the formation defining the void provides at least one free face which extends through the formation and the remaining portion of the formation within the boundaries of the retort being formed is explosively expanded towards such a free face. The vertical thickness of the horizontal sill pillar is sufficient to maintain a safe base of operation 42 over the fragmented mass after such explosive expansion.

In the exemplary embodiment, a plurality of vertically extending blasting holes including blasting holes 118, 119, 121, 124, 129, 133, 134, 135, and 136 are drilled through the sill pillar into formation remaining below below the sill pillar. The blasting holes are shown in the drawings out of proportion, i.e., the blasting holes can be smaller in diameter relative to the horizontal cross-sectional dimensions of the retort than shown in the drawings. Explosive is loaded into such blasting holes from the base of operation up to an elevation about the same as the bottom of the horizontal sill pillar, which is to remain unfragmented. Such explosive is detonated for explosively expanding subterranean formation toward such void below the sill pillar.

The portion of such blasting holes extending through the sill pillar can be used for introducing gas to the fragmented mass 12 from the base of operation 42 during the retorting process.

In preparing an in situ oil shale retort according to this method, one or more voids or pockets 50 can be present between the bottom of a portion of the unfragmented horizontal sill pillar and the top of the fragmented mass. As used herein, the term "pocket" refers to a cavity in the fragmented permeable mass which does not contain solid material. Thus, the top of the fragmented permeable mass can be separated from the top boundary of the retort by a pocket while another portion of the top of the fragmented permeable mass can be proximate to or essentially in contact with unfragmented formation forming the top boundary 32 of the retort. More than one pocket can be present, but one is sufficient for explanation of an embodiment of this invention.

These pockets create a serious problem when retorting oil shale in the fragmented mass, because the sill pillar above the pockets is unsupported. Hot gases in the fragmented mass can pass into the pocket causing thermal sloughing of the sill pillar, thereby reducing its effective thickness and weakening or otherwise jeopardizing the integrity of the sill pillar. Cracking or other structural failure of the sill pillar could make the base of operation at the top of the retort unsafe for full utilization during retorting.

Therefore, when establishing a combustion zone in the fragmented mass, and when retorting oil shale in the fragmented mass, it is important to maintain the temperature of the portion 52 of the bottom boundary of the horizontal sill pillar above such a pocket 50 below the temperature at which unfragmented formation of the horizontal sill pillar would slough into the pocket 50.

According to the present invention, to prevent such thermal sloughing, a primary combustion zone is established in a portion of the fragmented permeable mass which is proximate to the top boundary, that is, in a region where thermal sloughing cannot be extensive enough to significantly decrease stability of overlying formation. There is introduced to the fragmented mass a retort inlet mixture comprising sufficient oxygen for propagating the combustion zone across an upper portion of the fragmented mass. At the same time, there is introduced to the pocket 50 a fluid having a temperature less than the temperature at which unfragmented formation of the top boundary would slough into the pocket, and at a sufficient rate of flow to prevent thermal sloughing of formation from the top boundary into the pocket. Thus, a primary combustion zone can be established in the fragmented mass, including the fragmented mass below the pocket, without significant thermal sloughing from the bottom boundary of the horizontal sill pillar into the pocket. Cooling fluid can be introduced continuously or intermittently to the pocket 50 to prevent thermal sloughing.

Preferably sloughing is prevented by maintaining the pressure of gas in the pocket at least as high as the pressure of gas in the fragmented mass adjoining the pocket. This prevents hot gas from passing into the pocket.

To establish a primary combustion zone in a portion of the fragmented mass proximate to the top boundary 32, carbonaceous material in the oil shale is ignited by any known method as, for example, the methods described in U.S. Pat. No. 3,952,801, incorporated herein by this reference, or above-mentioned U.S. Pat. No. 3,661,423. In establishing a primary combustion zone by a method as described in the '423 patent, a combustible mixture is introduced into the retort through the conduits 118 and 133 and ignited. Only fragmented mass in a portion of the retort where the fragmented mass is proximate to or essentially in contact with the top boundary 32 of the retort is ignited. Retort off gas is withdrawn through the drift 44, thereby bringing about a movement of gas from top to bottom of the retort through the fragmented permeable mass of particles containing oil shale. The combustible mixture contains an oxygen supplying gas and a fuel such as propane, butane, shale oil, diesel fuel, natural gas, or the like.

As used herein, the term "oxygen supplying gas" refers to oxygen; air, air enriched with oxygen; air mixed with a diluent such as nitrogen, off gas from an in situ oil shale retort, or steam; and mixtures thereof.

The supply of combustion mixture to the primary combustion zone is maintained for a period sufficient for oil shale in the fragmented mass near the upper boundary 32 of the retort to become heated to a temperature higher than the spontaneous ignition temperature of carbonaceous material in the shale, and generally higher than about 900° F., so that the combustion zone can be sustained by the introduction of oxygen supplying gas without fuel. At a temperature higher than about 900° F., gases passing through the primary combustion zone and combustion gas produced in the primary combustion zone are at a sufficiently high temperature to retort oil shale on the advancing side of the combustion zone.

The period of establishing a self-sustaining primary combustion zone can be from a few hours to a few days in duration. When a self-sustaining primary combustion zone has formed, the retort off gas has little or no oxygen content because oxygen in the combustion mixture is depleted as the combustible mixture passes through the primary combustion zone.

Multiple ignition points can be used for establishing a primary combustion zone. The number of ignition points required depends upon the lateral extent of the retort, and the number and location of pockets in the fragmented mass. For the retort 8 shown in the drawnings, a primary combustion zone is established on both sides of the pocket 50 via bore holes 118 and 133.

After a self-sustaining primary combustion zone is formed, a first retort inlet mixture comprising an oxygen containing gas is introduced to the retort on the trailing side of the primary combustion zone through the bore holes 118, 133. By the continued introduction of the first retort inlet mixture, the primary combustion zone is advanced downwardly through the fragmented mass. Some lateral advancement of the primary combustion zone toward the pocket 50 also occurs.

Enhanced lateral propagation of the primary combustion zone can be effected by establishing a secondary combustion zone on the trailing side of the primary combustion zone. Advantages of retorting oil shale with a secondary combustion zone on the trailing side of the primary combustion zone are described in my U.S. patent application Ser. No. 844,035, filed on Oct. 20, 1977, entitled "Progress for Recovering Carbonaceous Values from In Situ Oil Shale Retorting", which is a continuation-in-part of coassigned U.S. patent application Ser. No. 728,911 filed on Oct. 4, 1976, and now abandoned. Both of these applications are incorporated herein by this reference. As described therein the secondary combustion zone is established by introducing downwardly into the retort a second retort inlet mixture comprising a fuel having a spontaneous ignition temperature less than the primary combustion zone and more than sufficient oxygen for oxidizing the fuel. The secondary combustion zone creates a region of high temperature behind the primary combustion zone which increases the resistance of gas flow through the primary and secondary combustion zones. The increased resistance is in turn, responsible for reducing the gas mass flow into the primary combustion zone.

As used herein, the term "secondary combustion zone" refers to the portion of the retort where the fuel of the second retort inlet mixture is burned. The "primary combustion zone" is the portion of the retort where the greater part of the oxygen in the first retort inlet mixtue that reacts with residual carbonaceous material is retorted oil shale in consumed. As used herein, the term "retorted oil shale" refers to oil shale heated to a sufficient temperature to decompose kerogen in an enviroment substantially free of free oxygen so as to produce liquid and gaseous products and leave a solid carbonaceous residue. The term "combusted oil shale" refers to oil shale through which a primary combustion zone has passed, the combusted oil shale having reduced carbon content due to oxidation. An individual particle containing oil shale can have a core of retorted oil shale and an outer "shell" of combustion oil shale. Such can occur when oxygen has diffused only part way through the particle during the time it is at an elevated temperature and in contact with an oxygen supplying gas.

The fuel for the second retort inlet mixture can be a gaseous fuel such as post-retorting gas from an in situ oil shale retort, of gas from an active in situ oil shale retort, if the off gas is of sufficiently high heating value, butane, propane, natural gas, liquefied petroleum gas, or the like; a liquid fuel such as shale oil, crude petroleum oil, diesel fuel, alcohol, or the like; a comminuted solid fuel such as coal; and mixtures thereof. The second retort inlet mixture can also include liquid or gaseous water.

A hot combustion gas is produced in the primary combustion zone. The combustion gas and any unreacted portion of the first retort inlet mixture pass from the advancing side of the primary combustion zone downwardly through a retorting zone in which gaseous and liquid products are produced by retorting oil shale.

The liquid and gaseous products produced in the retorting zone flow downwardly through the mass 12 of formation particles on the advancing side of the retorting zone into the drift 44 in communication with the bottom of the retort. The drift contains a sump 20 in which liquid products including shale oil and water are collected and from which liquid products are withdrawn through conduit means, not shown. A retort off gas containing gaseous products, combustion gas, carbon dioxide from carbonate decomposition, and any gaseous unreacted portion of the retort inlet mixture is also withdrawn by way of the drift.

Retorting of oil shale can be carried out with primary combustion zone temperatures as low as about 800° F. However, in order to have retorting at an economically fast rate, it is preferred to maintain the primary combustion zone at least at about 900° F. Preferably the primary combustion zone is maintained at a temperature of at least about 1150° F. for reaction between water and carbonaceous residue in retorted oil shale according to the water gas reaction.

The upper limit on the temperature of the primary combustion zone is determined by the fusion temperature of oil shale, which is about 2100° F. The temperature in the primary combustion zone preferably is maintained below about 1800° F. to provide a margin of safety between the temperature of the primary combustion zone and the fusion temperature of the oil shale. In this specification, where the temperature of the primary combustion zone is mentioned, reference is being made to the maximum temperature in that zone.

Sloughing of portions of the bottom of the sill pillar 46 into the pocket 50 can occur if the bottom boundary 52 of the sill pillar proximate to the pocket 50 is heated to a temperature of about 400° to 500° F. This can occur as the primary combustion zone is propagated toward the pocket 50 and as the primary combustion zone and the retorting zone are advanced downwardly through the fragmented mass.

To avoid such thermal sloughing, there is introduced to the pocket 50 a fluid having a temperature less than the temperature at which unfragmented formation of the bottom of the sill pillar would slough into the pocket, i.e., the temperature of the fluid introduced to the pocket is less than about 500° F. The temperature of the fluid can be about ambient temperature such as when air or water is introduced to the pocket. Such cooling fluid is introduced to the pocket 50 as the primary combustion zone is propagated toward and approaches the pocket. If desired, cooling fluid can be introduced to the pocket during the ignition stage of the retorting operation to provide back pressure to inhibit channeling of hot combustion gas to the pocket.

Cooling fluid is introduced to the pocket at a sufficient rate of flow to prevent thermal sloughing of formation from the bottom of the sill pillar into the pocket. When the primary combustion zone has propagated to a portion of the fragmented mass below the pocket, the flow of fluid introduced to the pocket is maintained at a sufficient rate and pressure to keep the primary combustion zone below the surface of the fragmented mass exposed to the pocket. Thus, the primary combustion zone is kept spaced apart from the pocket by a barrier of cool fluid introduced to the pocket.

Introduction of fluid to the pocket at a volumetric rate equal to about one-tenth of the rate of introduction of gas to the primary combustion zone is sufficient to avoid thermal sloughing of unfragmented formation into the pocket. For example, if the rate of introduction of retort inlet mixture into the fragmented mass is 0.6 SCFM (standard cubic foot per minute) per square foot of horizontal cross-sectional area of fragmented mass being retorted, then the cooling gas is introduced to the pocket at a rate of about 0.06 SCFM per square foot of horizontal cross-sectional area of the pocket.

Preferably cooling fluid is introduced to the pocket at a sufficiently high pressure that the pressure of gas in the pocket is at least equal to the pressure of gas in the fragmented mass adjacent the pocket. Most preferably the pocket has a positive pressure differential relative to the adjacent fragmented mass. This results in gas flow out of the pocket into the fragmented mass and prevents hot gas from the primary and secondary combustion zones from flowing into the pocket. This also prevents the secondary and primary combustion zones from propagating to the pocket.

The cooling fluid introduced to the pocket can be an oxygen supplying gas such as air, a non-reactive gas such as nitrogen or steam, cool off gas from an in situ oil shale retort and combinations thereof. The fluid can also be a liquid such as water. Both liquid and gas can be used simultaneously. An advantage of using gas instead of liquid as the cooling fluid is that gas is easily distributed through the pocket to avoid hot and cold spots without use of special equipment such as water spargers.

An advantage of using steam or other fluid free of oxygen is that a gas barrier containing substantially no oxygen is established in the fragmented mass around the pocket. This gas barrier can prevent the hot primary combustion zone from propagating into the fragmented mass adjacent the pocket. Steam generated in a steam plant can be used for this purpose.

Instead of generating the steam in a steam plant, liquid water can be introduced to the pocket. An advantage of introducing liquid water to the pocket instead of introducing steam is that a costly steam plant is not required. In addition, fragmented mass adjacent the pocket is cooled by heat transfer for heating and vaporization of the introduced water.

When the primary combustion zone is in the fragmented permeable mass below and vertically spaced apart from the pocket, a secondary combustion zone can be established at a location in the fragmented mass vertically spaced below the pocket. This can be effected by introducing to the pocket as the cooling fluid, a combustible mixture comprising fuel and at least sufficient oxygen for oxidizing the fuel. The mixture, which serves as a secondary combustion zone feed, has a spontaneous ignition temperature less than the temperature of the fragmented permeable mass adjacent the bottom of the pocket. Therefore, the mixtue ignites at a location in the fragmented mass spaced below the pocket. Because the mixture functions as a cooling gas, its temperature is less than the temperature at which formation comprising the top boundary of the retort would thermally slough into the pocket. Because the bulk of the oxygen in the mixture is consumed in a secondary combustion zone, the primary combustion zone is prevented from advancing to the pocket.

When the retort 8 is being operated in the mode that a combustible mixture comprising fuel is the cooling fluid introduced to the pocket 50, the cooling fluid can be a fluid having the same composition as the second retort inlet mixture comprising fuel introduced to the secondary combustion zone through the conduits 118 and 133. That is, when the primary combustion zone has been propagated to a location in the fragmented mass 12 spaced below at least a portion of the pocket 50, a retort inlet mixture comprising fuel and an oxygen bearing gas can be introduced to the pocket through conduit 124. As used herein, the spontaneous ignition temperature of a fluid mixture such as the second retort inlet mixture refers to the spontaneous ignition temperature at the conditions in the retort. The spontaneous ignition temperature of a fluid mixture is dependent upon the conditions at which the formation particles in the retort are contacted by the fluid mixture i.e., the spontaneous ignition temperature of the fluid mixture is dependent upon such process parameters as the total pressure in the retort and the partial pressure of oxygen and fuel at that location in the retort and any catalytic effects of oil shale.

Although this invention has been described in considerable detail with reference to certain versions thereof, other versions are within the scope of this invention. For example, although the drawings show a retort where there is a sill pillar above the fragmented mass, this invention is also useful for retorts not having a sill pillar.

Because of variations such as this, the spirit and scope of the appended claims should not necessarily be limited to the description of the preferred versions contained herein.

What is claimed is:

1. A method for retorting oil shale in an in situ oil shale retort in a subterranean formation containing oil shale, the retort having a top boundary of unfragmented formation and containing a fragmented permeable mass of formation particles, wherein a portion of the top of the fragmented permeable mass is separated from the top boundary, and another portion of the top of the fragmented permeable mass is proximate to the top boundary to thereby form at least one pocket intermediate the fragmented permeable mass and the top boundary, the method comprising the steps of:

igniting oil shale in a first portion of the fragmented permeable mass which is proximate to the top boundary and laterally separated from said pocket to establish a combustion zone in said first portion;

introducing to the combustion zone in the first portion a retort inlet mixture comprising oxygen for propagating the combustion zone across an upper portion of the fragmented permeable mass; and introducing to such pocket under a pressure greater than the pressure in the fragmented mass adjacent such pocket a fluid having a temperature less than the temperature at which unfragmented formation of the top boundary would slough into such pocket and at a sufficient rate of flow to prevent thermal sloughing of unfragmented formation from the top boundary into such pocket such that there is a flow of the fluid out of the pocket and into the fragmented mass.

2. The method of claim 1 in which the fluid is introduced to such pocket until at least a portion of the combustion zone is propagated to a location below and vertically spaced apart from such pocket.

3. The method of claim 2 in which the rate of flow of fluid introduced to such pocket is sufficient to maintain the combustion zone below the surface of the fragmented permeable mass exposed to such pocket.

4. The method of claim 1 in which the temperature of the fluid introduced to such pocket is less than about 500° F.

5. The method of claim 4 in which the combustion zone has a temperature greater than about 1150° F.

6. The method of claim 1 in which the fluid introduced to such pocket comprises air.

7. The method of claim 1 in which the fluid introduced to such pocket comprises steam.

8. The method of claim 1 wherein fluid is introduced to such pocket at a sufficiently high pressure that the pressure in such pocket is at least equal to the pressure of gas in the fragmented mass adjacent such pocket.

9. The method of claim 1 in which the fluid introduced to such pocket comprises liquid water.

10. A method for retorting oil shale in an in situ oil shale retort in subterranean formation containing oil shale, the retort having a top boundary of unfragmented formation and containing a fragmented permeable mass of formation particles, wherein a portion of the top of the fragmented permeable mass is separated from the top boundary, and another portion of the top of the fragmented permeable mass is proximate to the top boundary to thereby form at least one pocket intermediate the fragmented permeable mass and the top boundary, the method comprising the steps of:

establishing a primary combustion zone in a portion of the fragmented permeable mass which is proximate to the top boundary;

introducing to the fragmented permeable mass a retort inlet mixture comprising fuel and sufficient oxygen for oxidizing the fuel to generate a secondary combustion zone for propagating the primary combustion zone laterally across an upper portion of the fragmented permeable mass; and introducing to such pocket a fluid having a temperature less than the temperature at which unfragmented formation of the top boundary would slough into such pocket and at a sufficient rate of flow to prevent thermal sloughing of formation from the top boundary into such pocket.

11. The method of claim 10 in which the fluid introduced to such pocket comprises gas.

12. The method of claim 11 in which the temperature of the gas introduced to such pocket is less than about 500° F.

13. The method of claim 12 in which the combustion zone has a temperature greater than about 1150° F.

14. The method of claim 11 in which the gas introduced to such pocket comprises air.

15. The method of claim 10 wherein fluid is introduced to such pocket at a pressure such that the pressure in such pocket is at least equal to the pressure of gas in the fragmented mass adjacent such pocket.

16. The method of claim 10 in which the fluid introduced to such pocket comprises steam.

17. The method of claim 1 including the step of establishing a secondary combustion zone at a location in the fragmented permeable mass vertically spaced below such pocket when at least a portion of the primary combustion zone is at a location in fragmented permeable mass vertically spaced below such pocket.

18. The method of claim 17 wherein the step of introducing a fluid to such pocket comprises introducing to such pocket a secondary combustion zone feed comprising fuel and at least sufficient oxygen for oxidizing the fuel, the secondary combustion zone feed having a spontaneous ignition temperature less than the temperature of the primary combustion zone and greater than the temperature of fragmented permeable mass adjacent the bottom of such pocket.

19. The method of claim 1 wherein the step of introducing a fluid to such pocket comprises introducing to such pocket a mixture comprising fuel and sufficient oxygen for oxidizing the fuel when the primary combustion zone is at a location in fragmented permeable mass vertically spaced below at least a portion of such pocket, the mixture having a spontaneous ignition temperature less than the temperature of the primary combustion zone and greater than the temperature of fragmented permeable mass adjacent the bottom of such pocket.

20. The method of claim 1 wherein fluid is introduced to such pocket at a sufficiently high pressure that the pressure in such pocket is at least equal to the pressure of gas in the fragmented mass adjacent such pocket.

21. The method of claim 10 in which the primary combustion zone is propagated laterally toward such pocket by limiting the concentration of oxygen in the retort inlet mixture to only sufficient oxygen for oxidizing the fuel and for maintaining the leading edge of the primary combustion zone at substantially the same elevation in the fragmented mass.

22. The method of claim 10 including the step of establishing the secondary combustion zone at a location in the fragmented permeable mass vertically spaced below such pocket when at least a portion of the primary combustion zone is at a location in fragmented permeable mass vertically spaced below such pocket.

23. The method of claim 22 including the step of introducing to such pocket a secondary combustion zone feed comprising fuel and at least sufficient oxygen for oxidizing the fuel, the secondary combustion zone feed having a spontaneous ignition temperature less than the temperature of the primary combustion zone and greater than the temperature of fragmented permeable mass adjacent the bottom of such pocket, and wherein the temperature of the secondary combustion zone feed is less than the temperature at which formation forming the top boundary of the retort would thermally slough into such pocket.

24. The method of claim 22 including the step of introducing to such pocket a mixture comprising fuel and sufficient oxygen for oxidizing the fuel when at least a portion of the primary combustion zone is in fragmented permeable mass directly below a portion of such pocket, the mixture having a spontaneous ignition temperature less than the temperature of the primary combustion zone and greater than the temperature of fragmented permeable mass adjacent the bottom of the pocket, wherein the mixture is at a temperature less than the temperature at which formation forming the top boundary of the retort would thermally slough into such pocket.

25. A method for retorting oil shale in an in situ oil shale retort in a subterranean formation containing oil shale, such an in situ oil shale retort containing a fragmented permeable mass of formation particles containing oil shale, said fragmented mass having top, bottom and side boundaries of unfragmented formation, the method comprising the steps of: excavating a first portion of formation to form an open base of operation at an elevation in the formation above the top boundary of the fragmented mass being formed;

excavating a second portion of formation for forming at least one void within the boundaries of the fragmented mass being formed;

expanding a third portion of formation toward such a void to form a fragmented permeable mass of particles containing oil shale in an in situ oil shale retort and to leave a horizontal sill pillar of unfragmented formation between the top of the fragmented mass and the bottom of the base of operation, there being a pocket between the bottom of a portion of the horizontal sill pillar and the top of the fragmented mass there below;

establishing a primary combustion zone in an upper portion of the fragmented mass laterally spaced apart from such pocket;

introducing to the fragmented mass through the sill pillar a retort inlet mixture comprising oxygen for propagating the primary combustion zone across an upper portion of the fragmented permeable mass; and maintaining the temperature of the bottom of the horizontal sill pillar adjacent such pocket sufficiently low that the formation of the horizontal sill pillar remains unfragmented.

26. The method of claim 25 in which the oxygen concentration of the retort inlet mixture is maintained sufficiently low that the elevation of the primary combustion zone remains substantially unchanged as the primary combustion zone advances toward such pocket.

27. The method of claim 25 in which the temperature of the portion of the sill pillar adjacent such pocket is maintained sufficiently low by introducing a gas at about ambient temperature to such pocket.

28. The method of claim 25 in which the temperature of the portion of the sill pillar adjacent such pocket is maintained sufficiently low by introducing a fluid having a temperature less than about 500° F. to such pocket.

29. The method of claim 25 in which the fluid introduced to such pocket comprises steam.

30. The method of claim 29 in which the fluid introduced to such pocket comprises liquid water.

31. A method for retorting oil shale in an in situ oil shale retort in a subterranean formation containing oil shale, such an in situ oil shale retort containing a fragmented permeable mass of particles containing oil shale, said fragmented mass having top, bottom and side boundaries of unfragmented formation, the method comprising the steps of:

excavating a first portion of formation for forming at least one void within the boundaries of the fragmented mass being formed;

expanding a second portion of formation toward such a void to form a fragmented permeable mass of particles containing oil shale and to leave a top boundary of unfragmented formation at the top of the fragmented permeable mass, there being a pocket between a portion of the top boundary and the fragmented mass;

establishing a primary combustion zone in an upper portion of the fragmented mass laterally spaced apart from such pocket;

introducing to the fragmented mass through the top boundary a retort inlet mixture comprising fuel and more than sufficient oxygen for oxidizing the fuel for establishing a secondary combustion zone in the fragmented mass and for advancing the primary combustion zone in the fragmented mass toward such pocket; and maintaining the temperature of the bottom of unfragmented formation at the top boundary of the fragmented mass in a region adjacent such pocket sufficiently low that the top boundary remains substantially intact.

32. The method of claim 31 in which the oxygen concentration of the retort inlet mixture is maintained sufficiently low that the elevation of the primary combustion zone remains substantially unchanged as the primary combustion zone advances toward such pocket.

33. The method of claim 31 in which the temperature of the portion of the top boundary adjacent such pocket is maintained sufficiently low by introducing a fluid at about ambient temperature to such pocket.

34. The method of claim 31 in which the temperature of the portion of the top boundary adjacent such pocket is maintained sufficiently low by introducing a fluid having a temperature less than about 500° F. to such pocket.

35. The method of claim 34 in which the fluid introduced to such pocket comprises steam.

36. The method of claim 34 in which the fluid introduced to such pocket comprises liquid water.

37. A method for recovering values from an in situ oil shale retort in a subterranean formation containing oil shale, the retort containing a fragmented permeable mass of formation particles containing oil shale and having a top boundary and side boundaries of unfragmented formation, and wherein a portion of the top of the fragmented mass in the retort is separated from unfragmented formation at the top boundary by a pocket and another portion of the top of the fragmented mass is essentially in contact with unfragmented formation of the top boundary, comprising the steps of:

establishing a combustion zone in a portion of the fragmented mass that is essentially in contact with unfragmented formation of the top boundary of the retort;

propagating the combustion zone to a portion of the fragmented mass directly below such a pocket; and introducing a fluid to such pocket under a pressure at least equal to the pressure in the fragmented mass adjacent such pocket for keeping the combusting zone spaced apart from such pocket such that there is a flow of the fluid from the pocket to the fragmented mass.

38. The method of claim 27 in which the temperature of the fluid introduced to such pocket is less than about 500° F.

39. The method of claim 37 in which the temperature of unfragmented formation at the top boundary of the retort adjacent such pocket is maintained below the temperature at which the top boundary would thermally slough into such pocket by introducing a fluid having a temperature less than about 500° F. into such pocket.

40. The method of claim 37 in which the fluid introduced to such pocket comprises steam.

41. The method of claim 37 wherein fluid is introduced to such pocket at a sufficiently high pressure that the pressure in such pocket is at least equal to the pressure of gas in the fragmented mass adjacent such pocket.

42. The method of claim 37 in which the fluid introduced to such pocket comprises liquid water.

43. A method for retorting oil shale in an in situ oil shale retort in a subterranean formation containing oil shale, the retort containing a fragmented permeable mass of formation particles containing oil shale and having a top boundary and side boundaries of unfragmented formation, and wherein a portion of the top of the fragmented mass in the retort is separated from unfragmented formation of the top boundary by a pocket and another portion of the top of the fragmented mass is essentially in contact with unfragmented formation of the top boundary comprising the steps of:

establishing a primary combustion zone in a portion of the fragmented mass that is essentially in contact with unfragmented formation of the top boundary of the retort;

introducing a retort inlet mixture into the portion of the fragmented mass essentially in contact with unfragmented formation for a sufficient time for propagating at least a portion of the primary combustion zone to a portion of the fragmented mass directly below and spaced apart from such a pocket, the retort inlet mixture comprising fuel and more than sufficient oxygen for oxidizing the fuel for establishing a secondary combustion zone in the fragmented mass in at least a portion of the fragmented mass essentially in contact with unfragmented formation at the top boundary; and, introducing a fluid to such pocket for keeping the primary combustion zone spaced apart from such pocket.

44. The method of claim 43 wherein fluid is introduced to such pocket at a sufficiently high pressure that the pressure in such pocket is at least equal to the pressure of gas in the fragmented mass adjacent such pocket.

45. The method of claim 43 in which the temperature of the fluid introduced to such pocket is less than the temperature at which unfragmented formation of the top boundary would slough into such pocket.

46. The method of claim 43 in which the temperature of unfragmented formation at the top boundary of the retort adjacent such pocket is maintained below the temperature at which the top boundary would thermally slough into such pocket by introducing a fluid having a temperature less than about 500° F. to such pocket.

47. The method of claim 43 wherein the retort inlet mixture comprises sufficient oxygen for oxidizing the fuel for generating a secondary combustion zone, for propagating the primary combustion zone through the fragmented mass, and for retorting oil shale on the advancing side of the primary combustion zone.

48. The method of claim 43 in which the fluid introduced to such pocket comprises steam.

49. The method of claim 43 including the step of establishing a secondary combustion zone at a location in the fragmented permeable mass vertically spaced below such pocket when the primary combustion zone is at a location in fragmented permeable mass vertically spaced below at least a portion of such pocket.

50. The method of claim 49 wherein the step of introducing a fluid to such pocket comprises introducing to such pocket a secondary combustion zone feed comprising fuel and at least sufficient oxygen for oxidizing the fuel, the secondary combustion zone feed having a spontaneous ignition temperature less than the temperature of the primary combustion zone and greater than the temperature of fragmented permeable mass adjacent the bottom of such pocket.

51. The method of claim 43 wherein the step of introducing a fluid to such pocket comprises introducing to such pocket a mixture comprising fuel and sufficient oxygen for oxidizing the fuel when the primary combustion zone is at a location in the fragmented permeable mass spaced directly below at least a portion of such pocket, the mixture having a spontaneous ignition temperature less than the temperature of the primary combustion zone and greater than the temperature of fragmented permeable mass adjacent the bottom of such pocket.

52. A method for establishing a combustion zone across an in situ oil shale retort in a subterranean formation containing oil shale, the retort having a top boundary of unfragmented formation and containing a fragmented permeable mass of formation particles wherein a portion of the top of the fragmented permeable mass is separated from the top boundary of unfragmented formation by a pocket and another portion of the top of the fragmented permeable mass is proximate to the top boundary, the method comprising the steps of:

establishing a combustion zone in a portion of the fragmented permeable mass which is proximate to the top boundary; and introducing to the combustion zone in the fragmented permeable mass a retort inlet mixture comprising oxygen for propagating the combustion zone across an upper portion of the fragmented permeable mass, while;

introducing to such pocket a fluid having a temperature less than the temperature at which unfragmented formation of the top boundary would slough into such pocket and at a sufficient pressure for maintaining the pressure in such pocket at least equal to the pressure of gas in the fragmented mass adjacent such pocket to prevent thermal sloughing of formation from the top boundary into such pocket.

53. The method of claim 52 in which the fluid is introduced to such pocket until at least a portion of the combustion zone is propagated to a location below and vertically spaced apart from such pocket.

54. The method of claim 52 in which the temperature of the fluid introduced to such pocket is less than about 500° F.

55. The method of claim 54 in which the combustion zone has a temperature greater than about 1150° F.

56. The method of claim 52 in which the fluid introduced to such pocket comprises air.

57. The method of claim 52 in which the fluid introduced to such pocket comprises steam.

58. The method of claim 52 in which the fluid introduced to such pocket comprises liquid water.

* * * * *

UNITED STATES PATENT AND TRADEMARK OFFICE

CERTIFICATE OF CORRECTION

PATENT NO. : 4,192,552

DATED : March 11, 1980

INVENTOR(S) : Chang Yul Cha

It is certified that error appears in the above—identified patent and that said Letters Patent is hereby corrected as shown below:

Column 1, preceding "Background of the Invention" insert -- The Government of the United States of America has rights in this invention pursuant to Cooperative Agreement DE-FC20-78LC10036 awarded by the U. S. Department of Energy.--

Signed and Sealed this

*Twenty-sixth* Day of *January 1982*

[SEAL]

*Attest:*

GERALD J. MOSSINGHOFF

*Attesting Officer*

*Commissioner of Patents and Trademarks*